US010281213B2

(12) United States Patent
Clesen

(10) Patent No.: US 10,281,213 B2
(45) Date of Patent: May 7, 2019

(54) TAP-HOLE REFURBISHING

(71) Applicant: TMT—TAPPING MEASURING TECHNOLOGY SÀRL, Luxembourg (LU)

(72) Inventor: Romain Clesen, Colpach-Haut (LU)

(73) Assignee: TMT—TAPPING MEASURING TECHNOLOGY SÀRL, Luxembourg (LU)

( * ) Notice: Subject to any disclaimer, the term of this patent is extended or adjusted under 35 U.S.C. 154(b) by 124 days.

(21) Appl. No.: 15/103,281

(22) PCT Filed: Dec. 9, 2014

(86) PCT No.: PCT/EP2014/076972
§ 371 (c)(1),
(2) Date: Jun. 9, 2016

(87) PCT Pub. No.: WO2015/086557
PCT Pub. Date: Jun. 18, 2015

(65) Prior Publication Data

US 2016/0313063 A1 Oct. 27, 2016

(30) Foreign Application Priority Data

Dec. 9, 2013 (LU) ..... 92330

(51) Int. Cl.
*F27D 3/15* (2006.01)
*C21B 7/12* (2006.01)
*C21C 5/46* (2006.01)

(52) U.S. Cl.
CPC ..... *F27D 3/1527* (2013.01); *C21B 7/12* (2013.01); *C21C 5/4653* (2013.01)

(58) Field of Classification Search
CPC ..... F27D 3/1527; C21C 5/4653; C21B 7/12
See application file for complete search history.

(56) References Cited

U.S. PATENT DOCUMENTS 4,007,035 A * 2/1977 Smith ..... C21C 5/04 266/225
4,384,706 A 5/1983 Shirasaka et al.
(Continued)

FOREIGN PATENT DOCUMENTS

EP 0726439 A1 8/1996
GB 2203526 A 10/1988
(Continued)

OTHER PUBLICATIONS

International Search Report dated Jun. 25, 2015 re: Application No. PCT/EP2014/076972; pp. 1-4; citing: US 4 384 706 A, US 4 637 590 A, US 4 909 487 A, LU 90 486 A1, KR 100 832 528 B1, JP 2004 218022 A, US 2003/123942 A, US 2003/123942 A1, US 2001/007382 A1 and JP 2004 263261 A.
(Continued)

*Primary Examiner* — John C Hong
(74) *Attorney, Agent, or Firm* — Cantor Colburn LLP

(57) ABSTRACT

A method for refurbishing a tap-hole including making a channel trough a tap-hole block, restoring the channel to form a refurbished tap-hole, detachably connecting a pre-fabricated refractory insert including a shell to a clay gun, where the insert includes a first and second ends in axial direction, where the second end is blocked, an opening arranged on the first end, a hollow passage in the axial direction, where the hollow passage is accessible through the opening, a plurality of lateral through holes, aligned in a longitudinal direction of the shell, with a constant interval covering 10-25% of the shell, the method further including inserting the insert into the channel, where the clay gun is fluidly coupled with the insert and the channel, injecting a grouting material from the clay gun into the insert and through the through hole into the channel and, disconnecting the insert from the clay gun.

16 Claims, 3 Drawing Sheets

(56) References Cited

U.S. PATENT DOCUMENTS

| | | | |
|---|---|---|---|
| 4,637,590 | A | 1/1987 | Schneider |
| 4,909,487 | A | 3/1990 | Schneider |
| 2001/0007382 | A1 | 7/2001 | Raivo et al. |
| 2003/0123942 | A1 | 7/2003 | Grant et al. |

FOREIGN PATENT DOCUMENTS

| | | | |
|---|---|---|---|
| JP | 5695561 | U | 7/1981 |
| JP | 58151407 | A | 9/1983 |
| JP | 58199807 | A | 11/1983 |
| JP | 11201657 | A | 7/1999 |
| JP | 2004218022 | A | 8/2004 |
| JP | 2004263261 | A | 9/2004 |
| JP | 2006037126 | A | 2/2006 |
| KR | 100832528 | B1 | 5/2008 |
| LU | 90486 | A1 | 6/2001 |

OTHER PUBLICATIONS

Written Opinion dated Jun. 25, 2015 re: Application No. PCT/EP2014/076972; pp. 1-7; citing: US-A 4 384 706, US-A 4 637 590, US-A 4 909 487, LU 90 486 and KR-100 832 528B.

JP Office Action dated Mar. 13, 2018 re: Application No. 2016-538086; pp. 1-5; citing: JP 56-095561 A, JP 1999-201657 A, JP 2006-037126 A, JP 1983-151407 A and JP 1983-199807 A.

* cited by examiner

TAP-HOLE REFURBISHING

TECHNICAL FIELD

The present invention generally relates to a method for refurbishing tap-holes of arc furnaces, blast furnaces or smelter furnaces. Furthermore, the present invention relates to tap-hole inserts, which can be inserted into tap-hole channels of arc, blast or smelter furnaces to form refurbished tap-holes.

BACKGROUND ART

It is well known within the art that tap-holes of arc furnaces, blast furnaces or smelter furnaces are exposed to extreme conditions. Molten slag and metal are discharged from such furnaces through one or more tap-holes arranged in the lower section of the arc, blast or smelter furnace. Due to the high temperatures and the aggressive environment, the tap-hole wears out every time metal or slag is discharged. Therefore, each tap-hole can only be used for a limited number of taps before it has to be replaced. In more severe processes, the tap-hole is already worn-out after approximately 100 taps, which corresponds to 2 or 3 weeks of continuous operation.

Currently, tap-holes are refurbished by rebuilding each tap-hole manually with preformed bricks, which are clayed in the worn-out tap-hole of the arc, blast or smelter furnaces to form a "refurbished" tap-hole. Prior to bringing new bricks manually into position, old bricks have to be removed from the surroundings of the hot tap-hole.

As every arc, blast or smelter furnace has to be shut down prior to repairing the tap-holes, it is important that the repair is carried out as fast as possible. Cooling the arc, blast or smelter furnace down will require additional heating up time, which is an additional production and energy loss. Once repaired, the tap-hole needs to stay in working condition for as long as possible. Therefore, it is important that specialized craftsmen carry out the repair. Such craftsmen are difficult to find and their job is quite dangerous, since the old bricks and the casing of the arc, blast or smelter furnace are still very hot (about 500° C.-600° C.) even when the arc, blast or smelter furnace has been shut down. To prevent the craftsmen from being hurt, the procedure of repairing tap-holes has to be carried out very carefully.

As the craftsmen are working in a hazardous area, the preformed bricks for refurbishing the tap-holes are often not well positioned. In consequence, the discharged metal or molten slag can get between the bricks, wash out the filling and dislodge them. Therefore tap-holes, which are refurbished with preformed bricks, are not performing uniformly and may need to be replaced more frequently.

GB2 203 526 describes a method to refurbish a plug fitted in the sidewall of a steel-making vessel where the refractory material sealing the plug in place has been burned off after a number of pourings to create an enlarged approach well inside the steel-making vessel. A steel pipe is placed from the inside of the vessel in the worn plug using a boom and the steel pipe is sealed in place by a refractory material and the well is filled with settable refractory material which sinters or fuses with heat to effect the repair.

EP 0 726 439 describes a method of repairing a metallurgical vessel in the region of its tapping pipe, where a tapping pipe is inserted from below into the brickwork and held in place and then the gap between the pipe and the brickwork is filled from below with a filling material. Also disclosed is an arrangement for carrying out the method with a pressure plate on which the pipe can be placed, with diameter greater than the outside diameter of the gap. The pressure plate has an aperture through which the filling material can be inserted.

JP2004218022 describes a method for repairing a blast furnace tap-hole, comprising the steps of inserting a large block made of refractory for repairing the tap-hole. The block is a preformed two-layered structure which is set in position by press fitting the irregularly shaped refractory bricks into the region of the large block for repairing.

KR-100 832 528 B describes a method of re-enforcement of a tapping old sleeve of a converter with a device comprising a tube, a cylinder body and a piston. The tube comprises one or more holes at one end. The tube comprises a connection plate at the opposite end for fixing the tube to the sleeve. The cylinder body includes on one end a connection plate adapted to be mounted on the connection plate of the tube and on an opposite end a gas connection. The method of re-enforcement of the sleeve includes filling the tube with repair material, installing the piston in the tube, and mounting the cylinder body on the sleeve, the rear part of the piston playing the role of a guide of the piston inside the cylinder body. The device is then mounted onto the sleeve. The sleeve is then oriented vertically so that the tube also extends vertically. The gas connection is then pressurized in order to displace the piston upwards and push the repair material through the holes at the other end of the tube. The repair material pours from the holes and flows along the tube in order to fill the gap between the outside surface of the tube and the inside surface of the sleeve. After the repair material has dried, the device is dismantled and the tube is removed from the tapping hole.

BRIEF SUMMARY

Provided herein is a method for refurbishing a tap-hole, which is faster and safer.

In order to overcome the above-mentioned problem, provided herein is a method for refurbishing a tap-hole of an arc, blast or smelter furnace. The method for refurbishing a tap-hole comprises different steps.

In a first step, a tap-hole channel is made through the tap-hole block in the lower section of an arc, blast or smelter furnace. After a certain amount of taps, the tap-hole is worn-out due to erosion by the discharged molten metal and slag. To refurbish the tap-hole, the diameter of the worn-out tap-hole is increased to form a tap-hole channel. The increase in diameter of the tap-hole is necessary, since an insert with a greater outer diameter than the diameter of worn-out tap-hole is inserted into the tap-hole channel.

In a second step, a prefabricated, hollow, refractory tap-hole insert comprising a shell with a plurality of lateral through holes is detachably connected to a clay gun. The tap-hole insert has a hollow passage with one axial opening and a plurality of lateral through holes aligned in a longitudinal direction of the shell, with a constant interval in-between, and covering 10-25% of the shell of the tap-hole insert.

The tap-hole insert is preferably cylindrically shaped with a circular base. Square refractory tap-hole inserts can be used too. In case a square refractory tap-hole insert is used, corners need to be removed manually in the newly drilled round tap-hole channel, which is easy to do as only a comparatively small wall thickness is remaining.

After a tap-hole insert has been detachably connected to the clay gun, the tap-hole insert is inserted into the tap-hole channel. The tap-hole channel is thus fluidly coupled with the clay gun and the tap-hole insert because of the plurality of lateral through holes in the shell of the tap-hole insert.

Thereafter, a grouting material arranged inside the clay gun is injected from the clay gun into the tap-hole insert and exits through the plurality of through holes arranged in the shell of the tap-hole insert so as to completely fill the gap between the tap-hole channel and the tap-hole insert. The through holes end in a hollow section between the inner surface of the tap-hole channel and the outer surface of the tap-hole insert. The thickness of the hollow section can be determined by the outer diameter of the tap-hole insert and the diameter of the tap-hole channel. The thickness of the hollow section is preferably in the range of 40 to 100 mm. The clay gun injects grouting material through the tap-hole insert and the plurality of through holes until the hollow section between the tap-hole channel and the outer surface of the shell of the tap-hole insert is substantially filled with the grouting material.

The clay gun is disconnected from the tap-hole insert before the grouting material has completely cured. Once cured, the tap-hole insert is solidly fixed in the tap-hole channel.

An advantage of the present method is that the refurbishing can be done quickly and with a tool, which is readily available. Indeed because of the through hole in the tap-hole insert, the gap between the tap-hole channel and the tap-hole insert can easily be filled using the clay gun on which the tap-hole insert is fastened and by which it is inserted into the tap-hole channel. The tap-hole insert is maintained securely in position during the filling of the gap with grouting material by the clay gun itself. Due the fact that the gap can now be filled through the inside of tap-hole insert, the tap-hole insert can remain attached and held in position by the clay gun during the operation. Nobody needs to be near the tap-hole during the operation because the insertion and the filling of the gap between the tap-hole channel and the tap-hole insert is done via the clay gun. This method thus considerably increases the safety of the workers during the operation.

A drill bit may subsequently be used to pierce the tap-hole insert and thus remove the grouting material injected in the tap-hole insert, such that molten metal and/or molten slag may subsequently be discharged from the arc, blast or smelter furnace.

Preferably, the tap-hole insert is detachably connected to the clay gun by an adapter. The adapter is detachably connected with one end to the clay gun and with another end to the tap-hole insert.

According to a preferred embodiment of the invention, an appropriate grouting material is used for fixing the tap-hole insert to the tap-hole channel. Preferably, a grouting material is used that can be crafted (such as drilled) easily. The grouting material preferably comprises MgO or $Al_2O_3$ and withstands high temperatures, which depend on the molten material requirements. The grain size of the grouting material is preferably smaller than the grain size of clay materials, which are usually used to seal the tap-holes. A particularly preferred grouting material such as e.g. Bauxite veneers CW610 or Phosphate moldables by Sheffield Refractories can be used.

The method preferably comprises a step for inserting the insert until a collar of the tap-hole insert abuts against the arc, blast or smelter furnace outer tap-hole block, which will normally not be replaced. Preferably, the collar is configured so that no grouting material flows from the hollow passage past the collar. Preferably, the tap-hole insert is thus pressed sealingly with its collar against the outer tap-hole block.

A metal tap-hole plate can be fixedly attached to the arc, blast or smelter furnace wall to hold the tap-hole insert in place. The metal tap-hole plate can be bolted or fixed by wedges onto the arc, blast or smelter furnace wall. Alternatively, a metal tap-hole plate can be positioned and latched at the end of the tap-hole insert, such that the tap-hole insert is kept in place.

According to a preferred embodiment of the invention, the making of the tap-hole channel through the bottom section of the arc, blast or smelter furnace wall is carried out according to the following steps:

In a first step the tap-hole is opened with the first drill bit to form a first tap-hole opening with a first diameter. Preferably, the first drill bit used for opening the tap-hole is the same drill bit that is used for tapping.

Increase the first diameter of the tap-hole opening with a second drill bit to form a tap-hole channel, wherein the second drill bit is guided in the first tap-hole opening such that the tap-hole channel is collinear with the first tap-hole opening.

According to a preferred embodiment of the invention, additional drill bits are used to increase the diameter of the tap-hole channel. A third and/or fourth drill bit can be used to form a tap-hole channel. The first, the second, the third and/or fourth drill bits are detachably connected to a drilling hammer to form the tap-hole channel. Usually a drilling hammer is already provided for tapping the tap-holes to discharge molten metal and/or molten slag from the arc, blast or smelter furnace. The same drilling hammer is used for powering different drill bits of different diameters. The second drill bit has a second diameter greater than the first diameter of the first drill bit. The third drill bit has a third diameter greater than the second diameter of the second drill bit and fourth drill bit has a fourth diameter greater than the third diameter of the third drill bit.

According to a preferred embodiment of the invention, the first, second, third and/or fourth drill bits each have a drill area below or equal to a maximum drill capacity of the drilling hammer. The drill capacity is a maximum surface a drilling hammer is able to drill. In preference, a drill area of the first drill bit is between 0.8 and 1.2 times a drill area of the second drill bit.

Advantageously, the second, third and/or fourth drill bits each have a guiding section that is collinear with the first pilot opening and the tap-hole channel. The guiding section can be a cylindrical protrusion, which is inserted into the tap-hole opening and guides the drill bit.

Preferably, the first tap-hole opening is increased with a second drill bit having a second drilling diameter greater than the first diameter, the second guiding section is inserted into the first tap-hole opening to guide the second drill bit to form a second tap-hole opening. The second tap-hole opening is increased with a third drill bit. The third drill bit has a third diameter greater than the second diameter. The making of a tap-hole channel can be carried out very fast. The method is reliable and comparatively cheap, since only two additional drill bits are required.

Alternatively, the diameter of the worn-out tap-hole can be increased by removing adjacent bricks manually.

The prefabricated tap-hole insert comprises a shell, a base as well as a first end and a second end in axial direction wherein said second end is blocked. An opening is arranged in the first end, i.e. the end turned towards the clay gun. The tap-hole insert comprises a hollow passage in axial direction, which is accessible through the opening in the first end. The tap-hole insert further comprises a plurality of through holes, which are arranged in the shell of the tap-hole insert, such that the plurality of through holes are in fluid communication with the hollow passage between the tap-hole insert and the tap-hole channel. The through holes are arranged laterally such, that a grouting material can be injected through it with a clay gun so that the tap-hole insert can be fixed in place in the tap-hole channel. The person skilled in the art is able to arrange the through holes such, that the pressure applied by a clay gun is sufficient to inject the grouting material through the through holes.

The hollow passage in the tap-hole insert has multiple functions. The hollow passage can be engaged by an adapter so as to detachably connect the insert to a clay gun. Furthermore, the hollow passage is used as a channel for guiding the grouting material that is injected therein to the through holes. In addition, the inner circumference of the hollow passage substantially corresponds to the diameter of the refurbished tap-hole opening. During the tapping, the inner surface of the tap-hole insert is in direct contact with the hot molten material.

With the present tap-hole insert, the tap-holes can be refurbished faster, safer and more reliably than with traditional methods. The tap-hole inserts can be put in place very quickly, and the tap-holes, which are refurbished therewith last longer since they are positioned and sealed off under optimal conditions. Only a clay gun is required to put the tap-hole insert in place. As the clay gun is already available, no additional machinery is required for putting the tap-hole insert in place.

The tap-hole insert is closed at the second end, i.e. the end turned towards the inside of the furnace so that no grouting material is injected into the arc, blast or smelter furnace. The pressure available for injecting the grouting material into the hollow section when the tap-hole insert has been inserted can be used more efficiently. Since the second end is closed, no molten material is discharged through the refurbished tap-hole until the tap-hole has been tapped for the first time. As a result, multiple tap-holes can be refurbished and are automatically closed when they have been refurbished.

The tap-hole insert is preferably pierced i.e. the grouting material injected in the previous step and the stopper closing the second end of the insert are removed shortly after the insert has been placed in the furnace. The tap-hole is then closed again in the usual way with the clay gun and is then operational.

According to a preferred embodiment of the invention, the tap-hole insert is made out of a refractory casting material, such as $Al_2O_3$ or MgO or materials with similar or equal qualities, and can thus be highly automated. A quality control can be implemented easily so as to assure a good product quality before the tap-hole insert is inserted into the tap-hole channel.

Preferably, a collar is arranged at or near the first end of the tap-hole insert. The collar is destined to abut against the outer surface of the arc, blast or smelter furnace wall when the tap-hole insert is completely inserted into the opening.

Advantageously, the tap-hole insert has a length equal to or larger than the thickness of the arc, blast or smelter furnace wall. It may be preferable to use a tap-hole insert, which is longer then the thickness of the furnace wall so that the tap-hole insert protrudes inside the furnace. In this way, no turbulences near the furnace are created and the erosion of the furnace wall around the tap-hole is reduced. The service life of the tap-hole is thus increased. Preferably, the tap-hole insert has a length between 800 and 1200 mm. It is preferably from 50 mm to 200 mm longer than the actual thickness of the furnace wall at the tap-hole.

Preferably the plurality of through holes in fluid communication with the hollow passage point in different radial directions. The tap-hole insert has a plurality of through holes, which cover between 10 and 25% of the shell. Thanks to these through holes, the grouting material can be distributed equally (homogenously) in the hollow annular section.

According to a preferred embodiment of the invention, the hollow passage of the tap-hole insert has a diameter, which substantially corresponds to the diameter of a refurbished tap-hole. The hollow passage may thus have a diameter between 10 and 30 mm.

The inner surface of the refurbished tap-hole is smooth, without any grooves as the tap-hole insert is made of only one piece. Thanks to the insert, the refurbished tap-hole lasts longer than traditionally refurbished tap-holes.

The disclosure relative to a method of sealing a tap hole with a sealing rod as described in the rest of the description is not part of the invention.

The invention further relates to a method for closing a tap-hole insert. This method is particularly useful with the refurbished tap-hole inserts as described above. The method comprises the following steps:

- detachably connecting a sealing rod to a clay gun,
- inserting the sealing rod into a tap-hole insert so that there is a space between the tap-hole and the sealing rod,
- injecting a clay material in the space between the tap-hole insert and the sealing rod,
- holding the sealing rod in place until the clay material has at least partially cured,
- disconnecting the sealing rod from the clay gun such that the sealing rod remains in the tap-hole insert.

According to a preferred embodiment of the invention, the sealing rod is connected to the clay gun by a centering piece and said centering piece is removed from the sealing rod while disconnecting the sealing rod from the clay gun.

Preferably, the centering piece engages holding and retaining means of the sealing rod to detachably connect to the sealing rod.

The sealing rod preferably further comprises a center hole for centering the drill bit to open the tap-hole channel.

BRIEF DESCRIPTION OF THE DRAWINGS

Further details and advantages of the present invention will be apparent from the following detailed description of a non-limiting embodiment with reference to the attached drawings, wherein.

DESCRIPTION OF PREFERRED EMBODIMENTS

Figure 1:
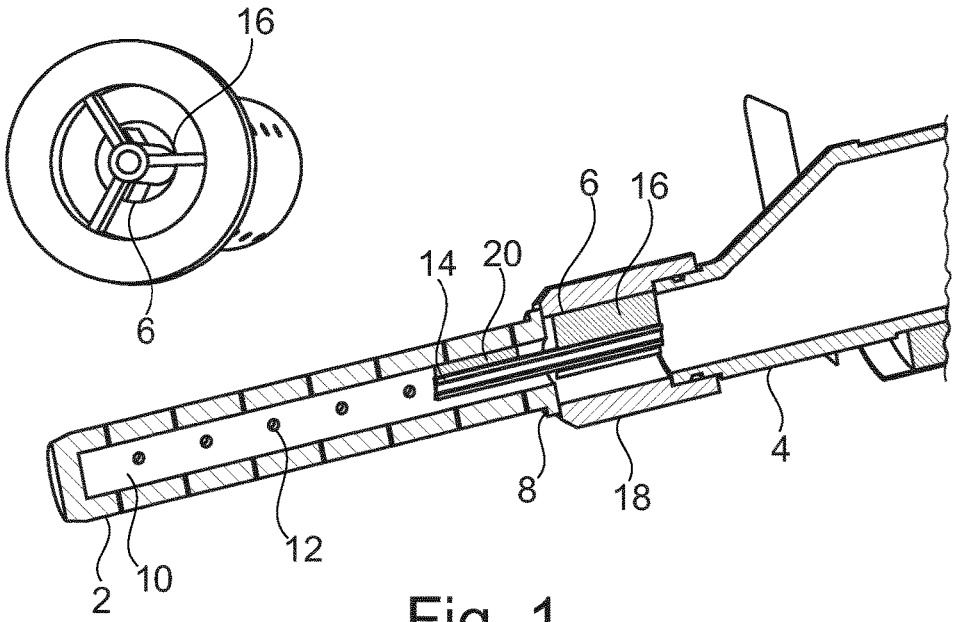
FIG. 1 is a schematic cross sectional view of a preferred tap-hole insert.
Figure 2:
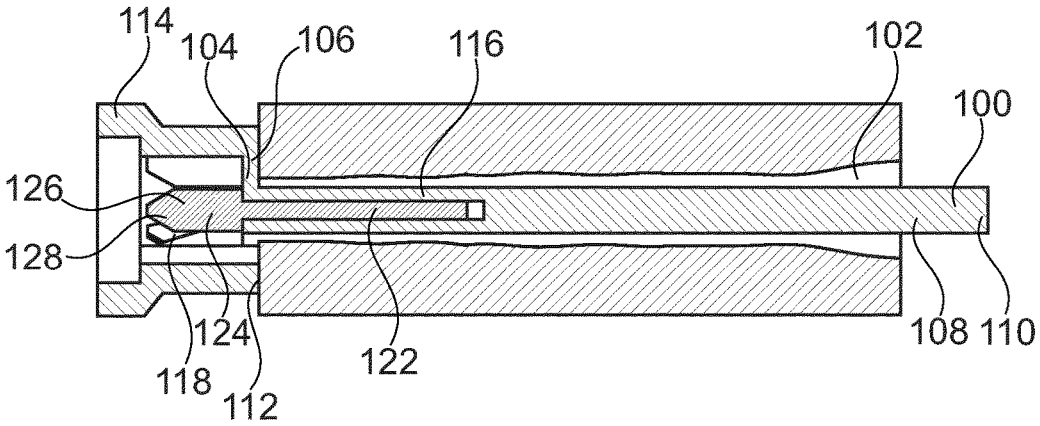
FIG. 2 is an axial section of a sealing rod, which has been inserted into the tap-hole.

In the following, a method for refurbishing a tap-hole according to a preferred embodiment of the invention is described. The method for refurbishing a tap-hole comprises multiple steps.

In a first step, a tap-hole opening is made for receiving a new tap-hole insert 2. The tap hole insert having a shell generally indicated by the reference numeral 2. The new tap-hole opening is preferably placed in the same spot in the lower section of the arc, blast or smelter furnace as the old worn-out tap-hole. According to a preferred embodiment of the invention, a drilling hammer, which is brought in place outside of the arc, blast or smelter furnace, increases the diameter of the old worn-out tap-hole by drilling a tap-hole channel that receives the tap-hole insert 2. As the diameter of the required tap-hole channel (between 150 mm or 250 mm) is larger than the diameter of the worn-out tap-hole, the tap-hole drilling hammers, which are used for tapping arc, blast or smelter furnaces do not usually provide the necessary power to bore an opening of a diameter of 150 mm or 250 mm or larger.

Therefore, the tap-hole channel is drilled out by using well-graded drill bits of different diameters. The first drill bit has the smallest outer diameter, which is equal to approximately 80 mm and forms a first tap-hole opening. Drill bits of this size are primarily used for opening blind tap-holes or for draining the slag or pig iron. In this case, the first tap-hole opening is used as a first pilot opening for receiving the second guiding section of the second drill bit. After the first opening has been drilled, the first drill bit is removed from the first opening and the first drill bit is detached from the drilling hammer. Subsequently, a second drill bit is attached to the drilling hammer. The second drill bit comprises a second drill section with an outer diameter of approximately 120 mm and a second guiding section, with a diameter of approximately 80 mm. The diameter of the second guiding section is substantially equal to the diameter of the first opening. The second guiding section protrudes into the first opening and serves as a centering device for drilling the second pilot opening, such that the second opening is collinear with the first opening. After the first opening has been increased to a diameter of 120 mm, the second drill bit is removed from the second opening and detached from the drilling hammer.

A third drill bit is attached to the drilling hammer. The third drill bit comprises a third drill section with an outer diameter of approximately 150 mm and a third guiding section with a diameter of approximately 120 mm. The third drill bit is inserted with its third guiding section in the second opening. The diameter of the second opening is increased to approximately 150 mm to form the tap-hole channel. After having finished with the drilling of the tap-hole channel, the drilling hammer is removed from the access area of the tap-hole channel.

The first guiding opening, the second guiding opening and the tap-hole channel are holes, which extend through the tap-hole block of the arc, blast or smelter furnace. The person skilled in the art chooses the material of the drill bits according to the material of the tap-hole block. Even if the arc, blast or smelter furnace is empty, before the first step is executed, the temperature inside the furnace is still very high. Therefore, the drill bits need to be chosen carefully. Preferably, the drill bits are made of a material that can withstand these high temperatures. It is important that the drilling is executed as fast as possible to prevent the arc, blast or smelter furnace from cooling down too much. As long as the drilling surface is equal or inferior to the drilling capacity of the drilling hammer, the drilling can be carried out quickly and safely. Preferably, all of the drill bits are chosen such that the drill area of each bit equals the maximum drilling capacity of the drilling hammer.

The only parts that have to be additionally purchased to carry out the drilling are the second and the third drill bits. The first drill bit and the drilling hammer are already available, since they have been used to open closed tap-holes before. The second and the third drill bit are comparatively inexpensive when compared to a new drilling hammer with higher drilling capacity. The method of opening the tap-hole by modifying machinery that is mostly already provided is faster and more secure than currently used methods, such as e.g. manual labor. Production losses are hence reduced and less energy is required for reestablishing the normal arc, blast or smelter furnace operation temperature.

In a next step, the tap-hole insert 2 is detachably connected to a clay gun 4 by means of an adapter 6. The adapter 6 engages the tap-hole insert 2, such that it is held in place until the tap-hole insert 2 is installed in the tap-hole opening.

The tap-hole insert 2 is made of a precast refractory, preferably comprising $Al_2O_3$ or MgO or materials with similar or equal qualities. The person skilled in the art selects the material to form the precast refractory from the materials that are known to withstand the conditions of the metallurgical process in the arc, blast or smelter furnace.

The tap-hole insert 2 has the shape of a hollow cylinder with a circular base. On one end, the hollow cylinder has an opening to a hollow passage 10 and one collar 8 with an outer collar diameter, which is larger than the diameter of the tap-hole opening. The tap-hole insert 2 is inserted into the tap-hole channel, such that the tap-hole collar 8 abuts against the tap-hole block of the arc or smelter furnace. On the other end, the tap-hole insert 2 is closed so that no fluid can exit the hollow passage in axial direction.

The outer diameter of the circular base is substantially equal to or smaller than the diameter of the tap-hole channel, such that it can be inserted into the tap-hole channel. The diameter of the hollow passage is substantially equal to the inner diameter of the "refurbished" tap-hole. The tap-hole insert has a length, which is substantially equal to or greater than the tap-hole block. The length of the tap-hole block is preferably between 800 and 1200 mm. It is particularly preferred that the length is chosen to be greater, such as from 50 mm to 200 mm longer, than the actual thickness of the furnace wall at the tap-hole. As a result, while molten metal is discharged from the arc, blast or smelter furnace through the tap-hole insert, the tap-hole block does not wear out.

Through holes 12 are arranged in the shell of the tap-hole insert so that they are pointing in a first radial direction and aligned in a longitudinal direction of the cylinder, with a first constant interval in-between. The amount of through holes 12 will depend on the grouting composition, its viscosity and its grain size. Advantageously, the cylinder has a second line of radial through holes 12 pointing in a second radial direction, aligned in the longitudinal direction of the cylinder with a second constant interval in between. The first constant interval can be equal to the second constant interval, while the first line of radial through holes 12 is set off by half the first constant interval from the second line of radial orifices in the longitudinal direction of the cylinder. The second line of radial through holes 12 is pointing in a second radial direction with an angle $\alpha$ of 90° to the first radial direction. The first and the second line of radial through holes 12 are also arranged on the opposite side of the tap-hole insert. They are arranged such that the grouting material can be injected and distributed easily and evenly in the annular hollow section without clogging. The diameter of each through hole 12 is for this particular advantageous embodiment in the range between 10 mm and 30 mm. The diameter of through holes 12 is chosen according to the grouting material, to the size of the substantially annular hollow section and to the maximum pressure that is applied onto the grouting material by the clay gun. At least 10-25% of the shell of the tap-hole insert is covered with through holes.

The through holes 12 can be bored into tap-hole insert 2 after the casting process.

The adapter element 6 is detachably connected with the first end to the clay gun and with the second end to the tap-hole insert 2. The adapter element 6 comprises a tube 14, which allows the passage of the grouting material from the clay gun to the hollow passage 10 of the tap-hole insert.

Three or more first spokes 16 are arranged on the circumference of the hollow tube 14, preferably distributed with equal spacing between the first spokes 16 on the circumference of the first end of the hollow tube 14. The first spokes 16 detachably connect the hollow passage 10 with the clay gun. Each of the three or more first spokes 16 is a rectangular cuboid with a first height, a first length and a first thickness. The first height corresponds to the distance between the circumference tube and the inner surface of the mouthpiece 18 of the clay gun 4. The first length is chosen such that the first spokes 16 can withstand the momentum and radial stress applied thereon by the weight of the tap-hole insert 2. The thickness of each of the at least three or more first spokes 16 is chosen such that there is a hollow space between the one or more first spokes 16.

Three or more second spokes 20 are arranged on the circumference of the hollow tube 14, preferably distributed with equal spacing between the second spokes 20 on the circumference of the second end of the tube 14. The second spokes 20 detachably connect the tube 14 with the tap-hole insert 2. Each of the two or more second spokes 20 is a rectangular cuboid with a second height, a second length and a second thickness. The second height corresponds to the distance between the circumference of the tube 14 and the inner surface of the hollow passage 10. The second length is chosen such that the second spokes 20 can withstand the momentum and radial stress applied thereon by the weight of the tap-hole insert 2. The thickness of each of the at least two or more second spokes 20 is chosen such that there is a hollow space between the one or more second spokes 20.

The outer diameter of the tube 14 can be adapted to reduce the amount of grouting material that remains between the inner surface of the tap-hole insert and the outer surface of the hollow tube. This is advantageous since less auxiliary grouting material has to be removed from the inner surface of the tap-hole insert.

In a next step, the tap-hole insert 2 is inserted into the tap-hole channel. For inserting the tap-hole insert 2, a clay gun 4 is put in place, outside of the arc, blast or smelter furnace such that the clay gun 4 can access the tap-hole opening.

After having inserted the tap-hole insert 2 into the tap-hole channel, a grouting material is injected from the clay gun 4 into the hollow passage 10 and through the through holes 12 so as to fill the space between the outer circumference of the tap-hole insert 2 and the tap-hole channel. The grouting material between the outer circumference of the tap-hole insert 2 and the inner surface of the tap-hole channel hardens while the tap-hole insert 2 is held in position. The clay gun 4 is removed before the grouting material has cured.

Preferably, a grouting material, such as plaster is used for this operation as other grouting materials may be too stiff for the injection and tend to clog inside the tap-hole insert 2. It is preferable to choose a grouting material fills up easily the gap between the new tap-hole insert and the outer tap-hole refractory.

For opening the refurbished tap-hole, the drilling hammer is put in place with the first drill bit attached thereon. The refurbished tap-hole opening (which has substantially the same diameter as the hollow passage of the insert) is drilled with the first drill bit. The final drilling removes any residual hardened grouting materials from the interior of the tube and opens the closed second end of the tap-hole insert 2. After the final drilling, the tap-hole insert 2 allows transmission of fluids from the interior of the arc, blast or smelter furnace to the exterior of the furnace.

The method is very time saving compared to currently performed methods. It is highly automated and can be carried out without the need of manual labor. As a result, no person is exposed to a hazardous area.

The refurbished tap-hole is of very high quality, since the materials for repairing the tap-hole can be optimally placed and the materials can be chosen carefully. Quality control can be carried out before the tap-hole insert 2 is inserted into the tap-hole channel. This is in contrast to manually refurbished tap-holes, where the preformed bricks are often not optimally placed and where no quality control can be carried out before the preformed bricks are put in place.

The invention further relates to a sealing rod 100 and a method for inserting such a sealing rod 100 into the tap-hole 102 before the clay material is injected therein.

Figure 3:
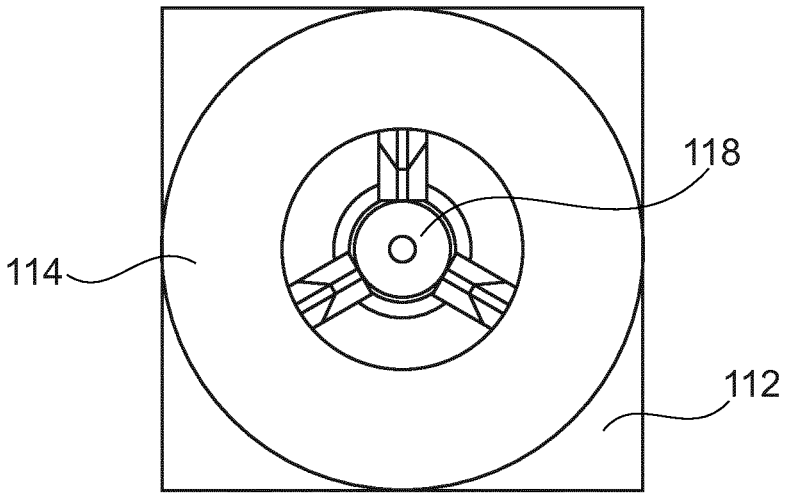
FIG. 3 is a cross-sectional view of an inserted sealing rod.

The sealing rod 100 in FIG. 3 can be used to seal any tap-holes 102, including tap-holes, which have been refurbished with tap-hole inserts 2.

The sealing rod 100 is a cylinder with a length l_sr, which is preferably greater than the length of the tap-hole channel or the tap-hole insert 2. The length of the sealing rod 100 is in a range between 0.8 m and 1.5 m. The diameter of the sealing rod 100 is preferably between 40 mm and 80 mm.

The sealing rod 100 is preferably made of refractory material. The mechanical properties of the sealing rod material are similar to the mechanical properties of the clay material once the clay material has hardened. Since less clay is put around the sealing rod 100, the clay hardens faster compared to traditional methods.

The sealing rod 100 has a diameter d_sr preferably between 40 mm and 80 mm between a first end 104, which comprises a collar 106 and a second end 108, which comprises a taper 110. When the sealing rod 100 is inserted into the arc, blast or smelter furnace wall, the second end 108 with the taper 110 penetrates axially into the tap-hole 102 until the first end 104 with the collar 106 is substantially flush with the external surface of the furnace wall. The taper 110 simplifies the insertion of the sealing rod 100 into the tap-hole 102. The collar 106 is chosen to sealingly engage the clay gun 114 and the outer surface of the tap-hole block 112. No clay can escape between the clay gun 114 and the wall of the arc, blast or smelter furnace.

The sealing rod 100 comprises holding and retaining means for detachably engaging a centering piece 118. According to a preferred embodiment of the invention, the holding and retaining means are a central borehole 116, which is coaxial with the central axis of the sealing rod 100. The central borehole 116 is accessible from the first end 104 of the sealing rod 100 where the collar 106 is located. The length of the borehole 116 is preferably between 0.25 and 0.5 times the length of the sealing rod 100 and has a diameter between 15 mm to 20 mm.

Firstly, the borehole 116 serves to detachably connect the sealing rod 100 to the centering piece 118 and thereby to the clay gun 114. The centering piece 118 is inserted into the borehole 116 of the sealing rod 100 to manipulate the sealing rod 100 such that it can be easily inserted into the tap-hole 102 using the clay gun 114 and to hold the sealing rod 100 inside the tap-hole 102 until the clay material around the sealing rod 100 has at least partially cured. The diameter of the borehole 116 is chosen such that it can engage the centering piece 118. The centering piece 118 is dimensioned to be able to resist the weight of the sealing rod 100.

Secondly, the borehole 116 can serve as a centering hole for a drill bit when the tap-hole 102 is reopened to tap the liquid metal or slag from the arc, blast or smelter furnace. As a result, the sealing rod 100 can be drilled more easily and more accurately.

Alternatively, the borehole 116 can also be placed eccentrically with regard to the central axis of the sealing rod 100. In this case the borehole 116 would not be used as a centering hole for a drill bit to reopen the tap-hole 102.

Figure 4:
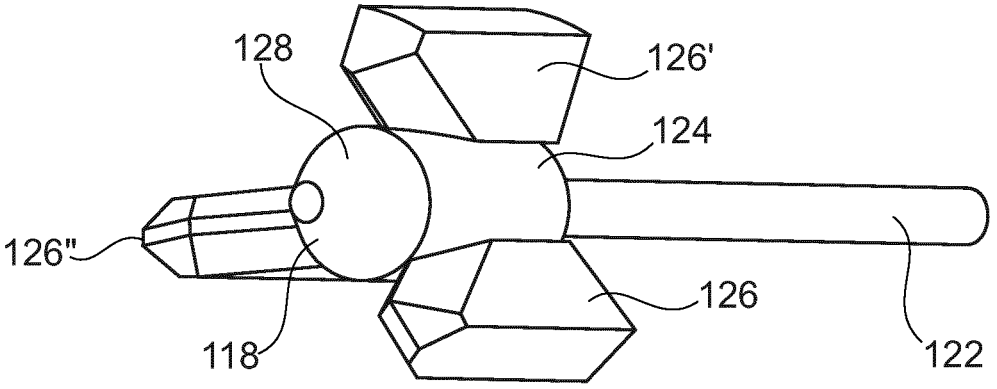
FIG. 4 is a schematic projection of a centering piece according to a preferred embodiment of the invention.
Figure 5:
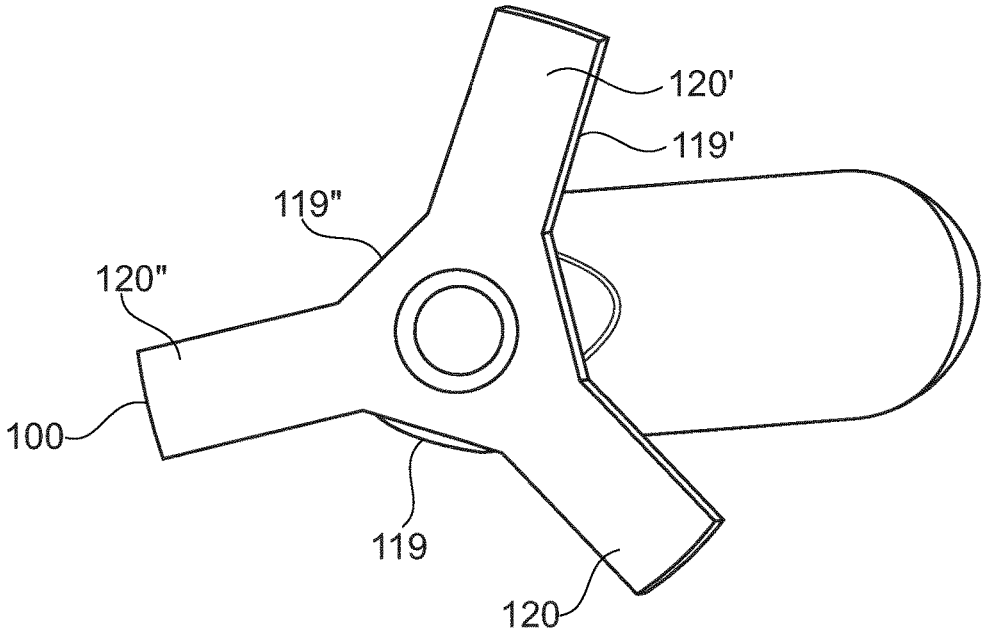
FIG. 5 is a schematic projection of a sealing rod according to a preferred embodiment of the invention.

The collar 106 in FIGS. 3, 4 and 5 comprises one or more openings so that the clay from the clay gun 114 can be injected into the space between the tap-hole 102 wall and the sealing rod 100. These openings are configured and dimensioned so as not to put too much resistance to the flow of the clay from the clay gun 114.

The openings are preferably eccentric with regard to the central axis of the sealing rod 100. According to a particular preferred embodiment of the invention, the openings are cut-outs 119, 119', 119". As a consequence, the collar 106 is formed by three bars 120, 120', 120" that extend perpendicularly from the central axis of the sealing rod 100. The surface of the cut-outs 119, 119', 119" is slightly bigger in size than the surface of the bars 120, 120', 120". The bigger the size of the cut-outs 119, 119', 119" the easier the clay can be injected into the space between the tap-hole 102 wall and the sealing rod 100. However, they must be dimensioned so that the sealing rod can be manipulated safely with the clay gun 114.

According to a preferred embodiment of the invention the cut-outs cover between 10% to 80% of the collar's 106 surface. Each one of the bars 120, 120', 120" in FIG. 6 points in a radial direction away from the central axis of the sealing rod 100. The bars 120, 120', 120" are spaced one from another by an angle $\alpha$ of approximately 120°. Each bar 120, 120', 120" has a thickness of 15-20 mm and a length of 30-50 mm and is manufactured in one piece with the sealing rod 100. The width of the bars 120, 120', 120" is preferably 2-4 times greater than the thickness. Each bar 120, 120', 120" is slightly curved on the extremity. The curve on the extremity corresponds to the course of a circle with a diameter equal to the length of the bar 120, 120', 120".

The centering piece 118 in FIG. 5 comprises a first cylinder 122, which is insertable into the borehole 116 of the sealing rod 100.

The centering piece 118 is preferably made of steel and withstands the momentum and the shear stress applied thereon by the sealing rod 100.

A second cylinder 124 of a larger diameter than or an equal diameter to the diameter of the first cylinder 122 is arranged on one end of the first cylinder 122. Three fins 126, 126', 126" are arranged in three different radial positions on the second cylinder 124 over its circumference. The angle between neighboring fins 126, 126', 126" is equal to an angle $\beta$ of approximately 120°. Each fin 126, 126', 126" has a thickness of 15-20 mm and a length of 20-40 mm along the direction of the central axis.

The centering piece 118 is inserted into the borehole 116 until the second cylinder 124 or the fins 126, 126', 126" abut with the collar 106 respectively with the bar 120, 120', 120" of the sealing rod 100. When the centering piece 118 is engaged into the borehole 116 of the sealing rod 100, the fins 126, 126', 126" of the centering piece 118 are aligned with the bars 120, 120', 120" of the collar 106 of the sealing rod 100 so as to minimize the resistance to the flow of clay from the clay gun 114.

The fins 126, 126', 126" and the end 128 of the cylinder 124 is also tapered in the direction of the clay gun 124, when the centering piece 118 is connected to the clay gun 124. The tapered fins 126, 126', 126" and the tapered end 128 are thus shaped to decrease the pressure of the clay material on the centering piece 118 during injection. The fins 126, 126', 126" are dimensioned so that they engage the clay gun 114 and assure a mechanical connection between the centering piece 118 and the clay gun 114. The fins 126, 126', 126" are shaped to engage the clay gun 114 and to withstand the momentum and the shear stress applied onto the centering piece 118 by manipulating the sealing rod 100.

The opening of the clay gun 114 through which the clay is injected in the tap-hole has a diameter between 100 mm and 150 mm. Since the diameter of the centering piece 118 is between 15 mm to 20 mm and the thickness of the fins 126, 126', 126" in the direction of the flow of the clay is between 15 and 20 mm, there is enough room for the clay to be injected efficiently into the tap-hole 102.

When the centering piece 118 and the sealing rod 100 are assembled, each fin 126, 126', 126" and each bar 120, 120', 120" are preferably aligned in the axial direction, as shown in FIG. 4. As a result, the passageway for the clay material through the cut-outs 119, 119', 119" is open and the fins 126, 126', 126" and/or the bar 120, 120', 120" do not block the flow of the clay material more than necessary.

In the following, a method according to the invention to seal a tap-hole 102 will be described. The sealing rod 100 can be used to seal any tap-holes.

In case the sealing rod 100 is used in combination with a tap-hole insert 2, the sealing rod 100 is placed into the tap-hole insert 2 after the grouting material inside the tap-hole 102 has been pierced. The subsequent steps of a method for sealing a tap-hole 102 without a tap-hole insert 2 are the same as the steps of a method for sealing a tap-hole 102 with a tap-hole insert 2.

The method for inserting the sealing rod 100 into the tap-hole 102 comprises the following steps:

In a first step, the centering piece 122 is inserted into the clay gun 114 with three fins 126, 126', 126" mechanically engaging the inner wall of the clay gun 114. The first cylinder 122 of the centering piece 122 is inserted into the borehole 116 of the sealing rod 100 in such a way that the clay gun 114 can be used to manipulate the sealing rod 100.

As the taper 110 of the sealing rod 100 is arranged on the opposite end of the collar 106 on the sealing rod 100, the taper penetrates first into the tap-hole 102 until the clay gun 114 abuts against the tap-hole block 112.

The clay gun 114 presses the collar 106 against the outer surface of the tap-hole block 112. As the taper 110 has the shape of a frustum of a circular cone it is easier to insert the sealing rod 100 into the tap-hole channel. The diameter of the frustum of the circular cone diminishes towards the tip of the sealing rod 100.

A clay material is injected from the clay gun 114 into the annular cavity between the tap-hole 102 and the sealing rod 100 along the fins 126, 126', 126" of the centering piece 118 and through the cut-outs 119, 119', 119" of the sealing rod 100. If there is any liquid remaining in the tap-hole 102, the injected clay material pushes it back.

After the clay material has partly hardened, the clay gun 114 is withdrawn and the centering piece 118 is removed from the sealing rod 100. The clay requires about 1 to 2 minutes to harden. Thereafter, the centering piece 118 disengages the sealing rod 100 and the sealing rod 100 stays inside the tap-hole 102 until the tap-hole 102 is reopened with a drilling hammer. The drill bit of the drilling hammer, which is used to pierce the tap-hole 102 has a slightly larger diameter than the diameter d_sr of the sealing rod 100. The diameter of the drill bit is preferably between 5% to 10% bigger than the diameter of the sealing rod 100. A part or all of the clay that has been injected to fix the sealing rod 100 in the tap-hole 103 is removed with the drilling hammer. As a result, a new sealing rod with the same diameter than the previous sealing rod 100 can be used to seal the tap-hole 102 of the arc, blast or smelter furnace.

Once the tapping of the furnace is finished, a new sealing rod 100 can be placed into the tap-hole 102.

The method is advantageous compared to other methods, which do not rely on sealing rods 100. When no sealing rod 100 is used to close the tap-hole 102, metal or slag can remain or penetrate in the tap-hole 102 and solidify therein. Once this material has solidified, it is difficult to reopen the tap-hole 102 with standard drilling equipment because this material is much harder than the clay used to seal the tap-hole. When inserting the sealing rod, any metal or slag, which may be in the tap-hole, will be pushed back in the furnace.

The tap-hole 102 can be reopened easily if a method for closing the tap-hole 102 as described above is used. The material, which has to be removed from the tap-hole 102 is mainly the sealing rod 100 and a little clay material, which has been injected in the space between the tap-hole and the sealing rod. Even if metal or slag penetrates the space between the sealing rod 100 and the tap-hole 102 the quantity of this material is so small that the drilling operation can be made without problems with the standard equipment.

Furthermore, substantially less clay material is used to seal the tap-hole 102 with a sealing rod 100 according to the invention.

The invention claimed is:

1. A method for refurbishing a tap-hole, said method comprising the following steps:

making a tap-hole channel trough a tap-hole block in a lower section of an arc, blast or smelter furnace, and restoring said tap-hole channel to form a refurbished tap-hole;

detachably connecting a sealing rod to a clay gun, inserting the sealing rod into a prefabricated, hollow, refractory tap-hole insert so that there is a space between the tap-hole insert and the sealing rod, detachably connecting the tap-hole insert comprising a shell to the clay gun, wherein said tap-hole insert comprises i. a first end and a second end in axial direction, wherein said second end is block, ii. an opening arranged on said first end, iii. a hollow passage in axial direction, wherein said hollow passage is accessible through said opening, iv. a plurality of lateral through holes, aligned in a longitudinal direction of the shell, with a constant interval in-between and covering 10-25% of the shell of the tap-hole insert, inserting said tap-hole insert into said tap-hole channel, wherein said clay gun is fluidly coupled with said tap-hole insert and said tap-hole channel, injecting a clay material in the space between the tap-hole insert and the sealing rod, holding the sealing rod in place until the clay material has at least partially cured, injecting a grouting material from said clay gun into said tap-hole insert and through said through hole into said tap-hole channel and, disconnecting the sealing rod from the clay gun such that the sealing rod remains in the tap-hole insert, disconnecting said tap-hole insert from said clay gun.

2. The method for refurbishing a tap-hole according to claim 1, wherein said tap-hole insert is detachably connected to said clay gun by an adapter.

3. The method for refurbishing a tap-hole according to claim 1, wherein said grouting material comprises magnesium oxide (MgO).

4. The method for refurbishing a tap-hole according to claim 1, wherein the length of the tap-hole insert is chosen to greater than a wall thickness of the furnace at location of the tap-hole.

5. The method for refurbishing a tap-hole according to claim 1, wherein said tap-hole insert is inserted until a collar of said tap-hole insert abuts against said tap-hole block of said arc, blast or smelter furnace.

6. The method for refurbishing a tap-hole according to claim 5, wherein said collar is pressed sealingly against said tap-hole block.

7. The method for refurbishing a tap-hole according to claim 5, wherein a metal tap-hole plate is fixedly attached to said arc, blast or smelter furnace wall to hold said tap-hole insert in place.

8. The method for refurbishing a tap-hole according to claim 1, wherein said making of said tap-hole channel through a tap-hole block is carried out according to the following steps:

opening said tap-hole with a first drill bit to form a first tap-hole opening with a first diameter; and increasing said first diameter of said first tap-hole opening with a second drill bit detachably connected to a drilling hammer to form said tap-hole channel, wherein said second drill bit is guided in said first tap-hole opening such that said tap-hole channel is collinear with said first tap-hole opening.

9. The method for refurbishing a tap-hole according to claim 8, wherein said first drill bit has a drill area which is between 0.8 and 1.2 times a drill area of said second drill bit.

10. The method for refurbishing a tap-hole according to claim 8, wherein said second drill bit has a guiding section, which guides said second drill bit collinear with said tap-hole opening for increasing said tap-hole channel.

11. The method according to claim 1, wherein the sealing rod is connected to the clay gun by a centering piece and said centering piece is removed from the sealing rod while disconnecting the sealing rod from the clay gun.

12. A prefabricated, hollow, refractory tap-hole insert for a tap-hole channel comprising a shell, wherein said tap-hole insert comprises:

a first end and a second end in axial direction, wherein said second end is block, an opening arranged on said first end, a hollow passage in axial direction, wherein said hollow passage is accessible through said opening, a plurality of lateral through holes, aligned in a longitudinal direction of the shell, with a constant interval in-between, covering 10-25% of the shell of the tap-hole insert and arranged in said shell such that said through holes are in fluid communication with said tap-hole channel.

13. The tap-hole insert according to claim 12, wherein said tap-hole insert is made out of a casting material or machined refractory material.

14. The tap-hole insert as claimed in claim 12, wherein said tap-hole insert has a collar, arranged at said first end of said tap-hole insert.

15. The tap-hole insert as claimed in claim 12, wherein said tap-hole insert has a length between 800 and 1200 mm.

16. The tap-hole insert as claimed in claim 12, wherein said hollow passage has a diameter of between 10 and 30 mm.

* * * * *